US006916161B2

(12) United States Patent
Brunner et al.

(10) Patent No.: US 6,916,161 B2
(45) Date of Patent: Jul. 12, 2005

(54) SYSTEM, METHOD, AND APPARATUS FOR SHIELDING SPARKS ORIGINATING FROM A COMPRESSOR IN A MARINE AIR CONDITIONER

(76) Inventors: John R. Brunner, 500 Sunset Dr., Euless, TX (US) 76040; Douglas Warner Place, 3332 Manchester Cir., Bedford, TX (US) 76021

( * ) Notice: Subject to any disclaimer, the term of this patent is extended or adjusted under 35 U.S.C. 154(b) by 0 days.

(21) Appl. No.: 10/675,526

(22) Filed: Sep. 30, 2003

(65) Prior Publication Data

US 2004/0060321 A1 Apr. 1, 2004

Related U.S. Application Data

(63) Continuation-in-part of application No. 10/215,796, filed on Aug. 9, 2002, now Pat. No. 6,701,733.

(51) Int. Cl.[7] ..... F04B 35/00
(52) U.S. Cl. ..... 417/362; 417/420; 62/240
(58) Field of Search ..... 62/240, 260, 305, 62/428, 434, 435; 165/41, 43, 44; 417/420, 316, 362

(56) References Cited

U.S. PATENT DOCUMENTS 5,358,456 A * 10/1994 Deppert et al. ..... 475/154
5,396,976 A * 3/1995 Koitabashi ..... 192/84.96
5,457,964 A * 10/1995 Hyde ..... 62/86
5,517,957 A * 5/1996 Wagner et al. ..... 123/192.1
5,848,536 A * 12/1998 Dodge et al. ..... 62/240
5,887,576 A * 3/1999 Wheeler et al. ..... 123/559.1
6,138,809 A * 10/2000 Kinoshita et al. ..... 192/84.961
6,199,391 B1 * 3/2001 Link et al. ..... 62/133
6,200,221 B1 * 3/2001 Maejima et al. ..... 464/45
6,263,689 B1 * 7/2001 Dodge et al. ..... 62/240
6,414,399 B1 * 7/2002 Bianchi ..... 290/1 A
6,663,521 B2 * 12/2003 Uryu et al. ..... 474/70
6,719,537 B2 * 4/2004 Kawaguchi et al. ..... 417/223

FOREIGN PATENT DOCUMENTS

JP 02000087850 A * 3/2000
JP 02001074119 * 3/2001

* cited by examiner

*Primary Examiner*—William E. Tapolcai
*Assistant Examiner*—Mohammad M. Ali
(74) *Attorney, Agent, or Firm*—Bracewell & Giuliani LLP

(57) ABSTRACT

A system for shielding sparks generated by a compressor in a marine air conditioning system is disclosed. The components of the compressor clutch are modified and a cap encapsulates the components that can generate sparks. In particular, the outer edges of the hub and of the pulley are designed to closely receive the cap. The diameter of the hub is smaller than that of the pulley so that the cap rotates with the pulley without contacting the hub. The cap is joined to the pulley by interference fit and always rotates with the pulley. Any sparks generated by contact between the hub and the pulley are completely contained within the cap to prevent ignition of any gas fumes present in the vicinity of the compressor.

13 Claims, 2 Drawing Sheets

SYSTEM, METHOD, AND APPARATUS FOR SHIELDING SPARKS ORIGINATING FROM A COMPRESSOR IN A MARINE AIR CONDITIONER

The present patent application is a continuation-in-part of U.S. patent application Ser. No. 10/215,796, filed on Aug. 9, 2002, now U.S. Pat. No. 6,701,733 entitled "Air Conditioning System for Marine Applications," and benefit thereto is claimed.

BACKGROUND OF THE INVENTION

1. Technical Field

The present invention relates in general to marine air conditioning systems and relates specifically a system, method, and apparatus for shielding sparks generated by a compressor in a marine air conditioning system.

2. Description of the Related Art

For many years, air conditioning units have been installed on boats to provide comfortable areas on the boat during warm weather. Various methods of cooling the air on boats have been used, including non-refrigerant cooling systems. However, a system using a compressed refrigerant is the most effective system in widespread use today.

In typical marine air conditioning systems, an electric motor drives a compressor for compressing refrigerant within a closed system. The refrigerant becomes heated as it is compressed, and it then passes through a condenser for cooling the refrigerant. The condenser may be an air-cooled unit, in which air passes over tubing in the condenser for drawing heat from the refrigerant as it passes through the condenser. Another type of condenser uses water to cool the refrigerant. A pump draws water through a hole in the hull of the boat and over the condenser tubes. Both methods sufficiently cool the refrigerant.

One disadvantage of using the current systems is that the electric motor typically requires the boat to be docked and connected to an outboard electrical source or to have an onboard generator. Without a generator, the system cannot be used when the boat is away from a dock. A disadvantage of a water-cooled system is that the system requires a separate water pump to pass water through the condenser. A related disadvantage is the additional holes in the hull that are required for the inlet and outlet of the pump for the condenser.

Many systems are available that use engine-driven compressors for compressing the refrigerant. However, these systems also use air-cooled condensers or water-cooled condensers that utilize a water pump in addition to that providing water to cool the engine. One solution to this problem is disclosed in the parent patent application in the present case, which is referenced above. That solution provides a marine air conditioning system having a water-cooled condenser that eliminates the need for a separate water pump for the condenser and the associated additional holes in the hull. Moreover, that system is operable while away from a dock.

Some air conditioner compressors utilize a clutch that cycles between engaged and disengaged positions by an electromagnetic coil. Movement of the clutch between these positions causes metal-to-metal contact and can be a source of sparks. For marine engines that operate on gasoline, this is a potentially hazardous situation in the bilge compartment since gas fumes can accumulate in the compartment if it is not properly vented.

SUMMARY OF THE INVENTION

One embodiment of a system, method, and apparatus for shielding sparks generated by a compressor in a marine air conditioning system is disclosed. The components of the compressor clutch are modified with machined surfaces, and a machined cap is employed to encapsulate the components that can generate sparks. In particular, the outer edges of the hub and of the pulley and bearing assembly are designed to closely receive the cap. The diameter of the hub is slightly smaller than that of the pulley and bearing assembly so that the cap rotates with the pulley without contacting the hub. The cap may be joined to the pulley by interference fit, for example, and always rotates with the pulley. Any sparks generated by contact between the hub and the pulley are completely contained within the interior of the cap to prevent ignition of any gas fumes present in the vicinity of the compressor. This design is well suited for use with a marine air conditioning system.

The foregoing and other objects and advantages of the present invention will be apparent to those skilled in the art, in view of the following detailed description of the present invention, taken in conjunction with the appended claims and the accompanying drawings.

DESCRIPTION OF THE DRAWINGS

So that the manner in which the features and advantages of the invention, as well as others which will become apparent are attained and can be understood in more detail, more particular description of the invention briefly summarized above may be had by reference to the embodiment thereof which is illustrated in the appended drawings, which drawings form a part of this specification. It is to be noted, however, that the drawings illustrate only an embodiment of the invention and therefore are not to be considered limiting of its scope as the invention may admit to other equally effective embodiments.

DESCRIPTION OF THE INVENTION

Figure 1:
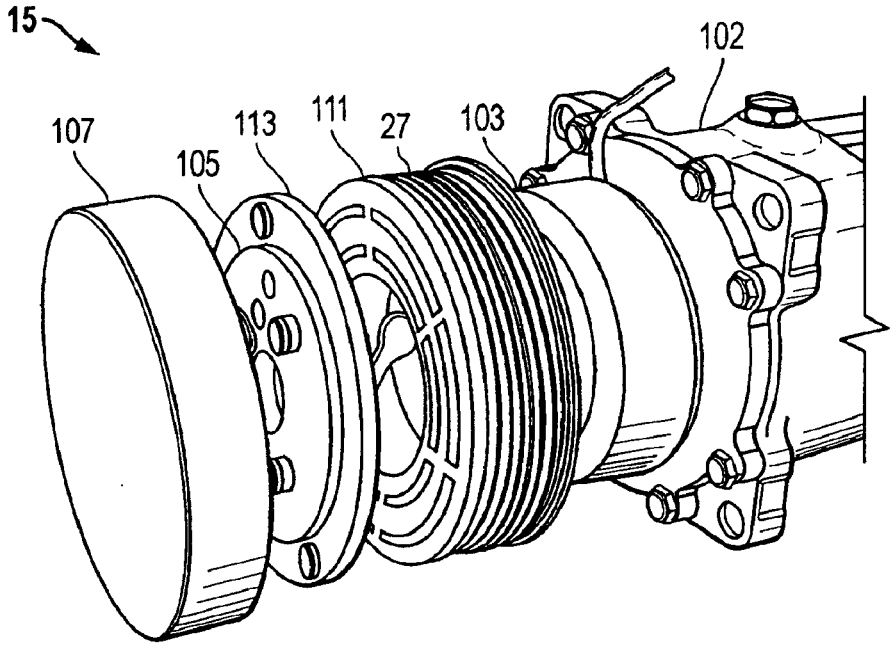
FIG. 1 is an exploded isometric view of a marine air conditioning compressor clutch constructed in accordance with the present invention.
Figure 2:
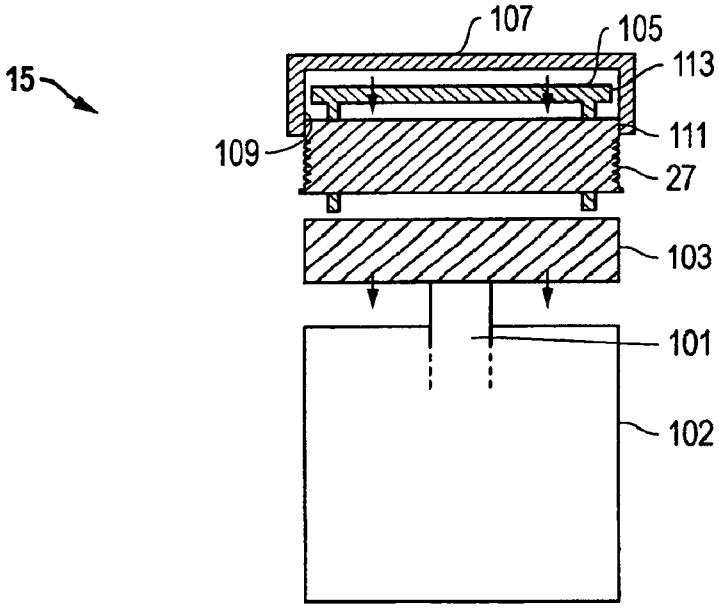
FIG. 2 is a sectional side view of the compressor clutch of FIG. 1.

Referring to FIGS. 1 and 2, one embodiment of a system, method, and apparatus for shielding sparks generated by a compressor 15 in a marine air conditioning system is disclosed. The compressor 15 has a shaft 101 extending from a compressor housing 102. A clutch pulley and bearing assembly 27 (hereinafter, pulley 27) is mounted on the shaft 101 and, in the version shown, is belt-driven. A field coil 103 and a hub 105 are also mounted to shaft 101 but on opposite sides of the pulley 27. When the field coil 103 is energized, the hub 105 is attracted toward it, thereby drawing the pulley 27 to engage and drive the compressor 15. The compressor 15 is not driven by the pulley 27 when the field coil 103 is de-energized.

One embodiment of the compressor 15 of the present invention also includes a machined cap 107 that is joined to thereto. In the version shown, cap 107 has an internal surface 109 with a precisely machined internal diameter. The internal surface 109 is designed to closely receive a machined outer circumferential edge 111 on the pulley 27 for an interference fit, for example. Thus, the cap 107 always rotates with the pulley 27. In the embodiment shown, edge 111 is located on the axially outer end of pulley 27. In addition, the outer circumferential edge 113 of the hub 105 is precisely machined to a diameter that is slightly smaller than a diameter of edge 111. Edge 113 does not make contact with internal surface 109. Cap 107 is designed to encapsulate any sparks that are generated by the metal-to-metal contact between hub 105 and pulley 27. The sparks are completely contained within the interior of the cap 107 to prevent ignition of any gas or flammable fumes present in the vicinity of the compressor 15.

Figure 3:
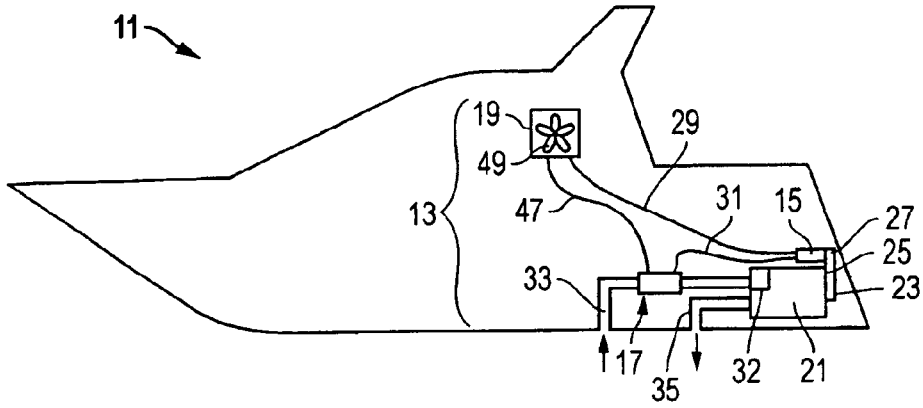
FIG. 3 is a schematic view of an air conditioning system according to the invention and installed on a boat.

Referring now to FIG. 3, one embodiment of a boat 11 having an air conditioning system 13 that utilizes the compressor 15 is shown. System 13 is a sealed system containing a refrigerant (not shown) used in a refrigeration cycle. In this embodiment, the system 13 is engine-driven and water-cooled to provide cool air to a passenger cabin, helm, or other desired location on boat 11 without the need for an external power source to be connected to boat 11. The main components of system 13 are compressor 15, condenser 17, and evaporator 19.

Compressor 15 is mounted on or near engine 21. A belt pulley 23 on engine 21 is connected by belt 25 to the pulley 27 on compressor 15. When the engine 21 is operating, pulley 23 rotates with engine 21, turning belt 25 and pulley 27. Pulley 27 is operably connected to a reciprocating piston (not shown), rotary valve, or other means located within compressor 15 for compressing the refrigerant within system 13. A clutch or other type of controller (not shown) selectively controls the output of compressor 15. The refrigerant enters compressor 15 through hose 29, which extends from evaporator 19, and exits compressor 15 through hose 31, which extends to condenser 17.

A pump 32, which may be driven by engine 21, as shown, or by other means, is used to draw raw water for cooling engine 21 into an intake tube 33, through engine 21, and out of discharge tube 35. Though shown as drawing water through a hole formed in the hull of boat 11, intake tube 33 may alternatively draw water from an outdrive portion of the propulsion system. Discharge tube 35 typically incorporates an outlet for exhaust gases from engine 21 and may discharge water through the hull, as shown, or at other locations on boat 11. Alternatively, water drawn through intake tube 33 may pass through a liquid-to-liquid heat exchanger for transferring heat from a separate, closed cooling system for engine 21, the raw water exiting out of discharge tube 35 without passing through engine 21.

Condenser 17 is installed in intake tube 33, the water passing through condenser 17 before passing through engine 21. The water cools the compressed refrigerant flowing through condenser 17 and cools engine 21 before exiting boat 11 through discharge tube 35. Though heat is transferred from the refrigerant to the water passing through condenser 17 prior to cooling engine 21, the amount of heat transferred does not interfere with cooling of engine 21. At least one oil cooler (not shown) or similar heat exchanger is typically located in intake tube 33, the coolers preferably being located downstream of condenser 17. This orientation allows cool intake water to first pass through condenser 17, increasing the coefficient of performance of system 13.

Figure 4:
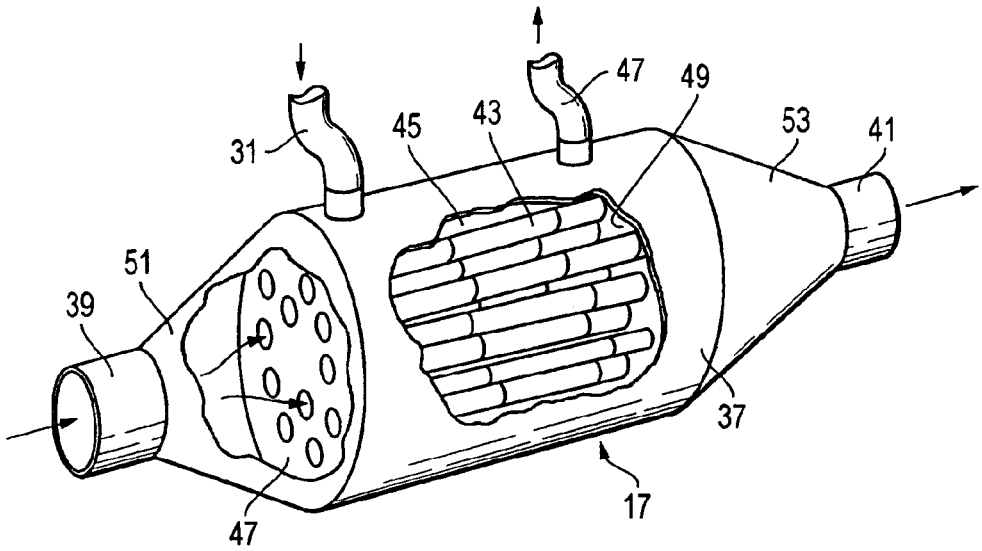
FIG. 4 is a perspective view of the condenser of FIG. 3.

FIG. 4 shows details of condenser 17. In the preferred embodiment, condenser 17 has a cylindrical outer body or housing 37, an inlet 39, and an outlet 41. Portions of outer housing 37 are shown removed, revealing tubes 43 located in interior volume 45 within housing 37. The walls of inlet 39 and outlet 41 are sealingly connected to header plates 47, 49, header plate 47 being visible near inlet 39. The ends of tubes 43 are connected to header plates 47, 49, creating a chamber, or manifold 51, 53, on each end of condenser 17. Manifold 51 communicates inlet 39 with tubes 43, and manifold 53 communicates tubes 43 with outlet 41, the plurality of tubes 43 providing multiple paths for water to flow between inlet 39 and outlet 41. Hose 31 and hose 47 are connected to housing 37 and communicate with volume 45 for passing refrigerant through volume 45 and around tubes 43. Having multiple tubes 43 provides for increased surface area for the thermal interface between the refrigerant in volume 45 and the water in tubes 43.

Referring again to FIG. 3, refrigerant passes from condenser 17 to evaporator 19 through hose 47. An expansion valve (not shown) is located before evaporator 19, the valve causing a pressure and temperature drop in the refrigerant. A fan 49 blows air across evaporator 19 for cooling the air through heat transfer to the refrigerant. The refrigerant exits evaporator 19 through hose 29 and flows to compressor 15 for recirculation in system 13.

In operation, engine 21 rotates pulley 23 and operates a water pump to move water into intake 33, through engine 21, and out of discharge 35. Belt 25 connects pulley 27 on compressor 15 to pulley 23, rotating pulley 27 as pulley 23 rotates. A reciprocating piston or other means, operated by pulley 27, compresses gaseous refrigerant contained in system 13. The temperature of the refrigerant increases as it is compressed.

The refrigerant flows through hose 31 from compressor 15 to condenser 17. Condenser is located inline with intake tube 33, through which the pump draws water for cooling engine 21. Water flows into condenser 17 through inlet 39, through tubes 43, and exits through outlet 41. Refrigerant flows from hose 31 into volume 45 and passes in and around tubes 43. Heat is transferred from the warmer, compressed, gaseous refrigerant to the cooler water through the sidewalls of tubes 43. In the embodiment shown, the heated water flows out of condenser 17, through engine 21, and into tube 35 for discharge into the surrounding water, though the water may alternatively flow through a liquid-to-liquid heat exchanger rather than through engine 21. Condenser 17 condenses the hot, gaseous refrigerant into a cooler, liquid refrigerant.

The cooled, liquid refrigerant flows from condenser 17 to evaporator 19 through hose 47. An expansion valve, located upstream of evaporator 19 and considered part of an evaporator assembly, causes a pressure and temperature drop in the refrigerant, converting the refrigerant to a cold gas. Fan 49 blows ambient air over evaporator 19, and heat is transferred from the air to the cold refrigerant. The cooled air is then circulated in selected areas of boat 11. The refrigerant flows out of evaporator 19 as a heated gas and into hose 29 for return to compressor 15 and recirculation through system 13. This cycle continues while compressor 15 and the water pump are operated by engine 21.

The present invention has several advantages including the ability to shield sparks generated by a compressor in a marine air conditioning system is disclosed. The invention only requires slight modification of the compressor clutch to encapsulate the components that can generate sparks. Any sparks generated by contact between the hub and the pulley are completely contained within the interior of the cap to prevent ignition of any gas fumes present in the vicinity of the compressor.

This design is well suited for marine air conditioning systems, particularly those with an engine-driven compressor and a water-cooled condenser to provide cool air in a boat without the need for external power. The condenser is located in the intake for cooling water for the engine, and water is drawn through the condenser by the engine water pump, eliminating the need for a second pump. Existing water conduits for cooling the engine may be used to provide cooling water for the condenser, thus additional holes in the hull, which are undesirable, are not required.

While the invention has been shown in only one of its forms, it should be apparent to those skilled in the art that it is not so limited, but is susceptible to various changes without departing from the scope of the invention. For example, the condenser may have a different exterior shape or configuration for fluid flow, such as concentric tubes or a single serpentine or coiled tube. In addition, the cap may be attached by many other means, such as machined threads or set screws, for example. Also, the water pump and compressor may be driven by various means, e.g., shafts, gears, etc.

What is claimed is:

1. A compressor, comprising:

a compressor housing;

compressing means for compressing a refrigerant located within the compressor housing;

a shaft extend from said means;

a pulley mounted to the shaft for rotation therewith;

a hub mounted to the shaft on an outer axial end of the pulley;

an electromagnetic coil for drawing the hub toward the compressor, the electromagnetic coil being located between the compressor housing and the pulley; and a cap mounted to the pulley for containing any sparks generated by contact between the hub and the pulley.

2. The compressor of claim 1, wherein the cap is mounted to the pulley exclusively by interference fit.

3. The compressor of claim 1, wherein the cap has a cylindrical internal surface with a precisely machined internal diameter that closely receives a cylindrical outer circumferential edge on the pulley.

4. The compressor of claim 1, wherein the cap always rotates with the pulley.

5. The compressor of claim 3, wherein the outer circumferential edge on the pulley is located on an axially outer end of the pulley.

6. The compressor of claim 1, wherein the hub has an outer circumferential edge with a diameter that is smaller than a diameter of outer circumferential edge on the pulley.

7. The compressor of claim 1, wherein an outer circumferential edge on the hub does not make contact with an internal surface of the cap.

8. In a boat having an engine and a raw-water pump, the raw-water pump having a raw-water intake that draws raw water from a body of water on which the boat floats and circulates the raw water for cooling the engine, the improvement comprising:

a compressor driven by the engine for compressing refrigerant, the compressor having a shaft, a pulley mounted to the shaft for rotation therewith, a hub movably mounted to the shaft on an outer axial end of the pulley, an electromagnetic coil for drawing the hub toward the compressor, and a cap mounted to the pulley for encapsulating any sparks that are generated by engagement of the compressor when the hub and pulley make contact;

a refrigerant condenser having a refrigerant passage and a raw-water passage in thermal communication with each other, the refrigerant passage having an inlet connected to an outlet of the compressor, the raw-water passage being connected to the raw-water intake for cooling the refrigerant;

an evaporator assembly connected between the condenser and an inlet of the compressor for exchanging heat with ambient air in the boat; and the cap has a cylindrical internal surface with a precisely machined internal diameter that closely receives a cylindrical outer circumferential edge on the pulley such that the cap is mounted to the pulley exclusively by interference fit.

9. The boat of claim 8, wherein the cap always rotates with the pulley.

10. The boat of claim 8, wherein the outer circumferential edge on the pulley is located on an axially outer end of the pulley.

11. The boat of claim 10, wherein the hub has an outer circumferential edge with a diameter that is smaller than a diameter of the outer circumferential edge on the pulley.

12. The boat of claim 11, wherein the outer circumferential edge on the hub does not make contact with the internal surface of the cap.

13. A compressor, comprising:

a compressor housing;

compressing means for compressing a refrigerant located within the compressor housing;

a shaft extend from said means;

a pulley mounted to the shaft for rotation therewith;

a hub mounted to the shaft on an outer axial end of the pulley;

an electromagnetic coil for drawing the hub toward the compressor, the electromagnetic coil being located between the compressor housing and the pulley;

a cap mounted to the pulley exclusively by interference fit for containing any sparks generated by contact between the hub and the pulley, the cap having a cylindrical internal surface with a precisely machined internal diameter that closely receives a cylindrical outer circumferential edge on the pulley such that the cap always rotates with the pulley; and wherein the outer circumferential edge on the pulley is located on an axially outer end of the pulley, and the hub has an outer circumferential edge with a diameter that is smaller than a diameter of the outer circumferential edge on the pulley such that the outer circumferential edge on the hub does not make contact with the internal surface of the cap.

* * * * *